US008274354B2

(12) United States Patent
Zillmann et al.

(10) Patent No.: US 8,274,354 B2
(45) Date of Patent: Sep. 25, 2012

(54) TWO- OR MULTIPHASE TRANSFORMER

(75) Inventors: Karl-Heinz Zillmann, Marsberg (DE); Wolfgang Moenig, Brilon (DE); Benjamin Weber, Winterberg (DE)

(73) Assignee: ABB Technology AG, Zurich (CH)

( * ) Notice: Subject to any disclaimer, the term of this patent is extended or adjusted under 35 U.S.C. 154(b) by 28 days.

(21) Appl. No.: 12/860,545

(22) Filed: Aug. 20, 2010

(65) Prior Publication Data

US 2011/0001600 A1 Jan. 6, 2011

Related U.S. Application Data

(63) Continuation of application No. PCT/EP2009/001095, filed on Feb. 17, 2009.

(30) Foreign Application Priority Data

Feb. 22, 2008 (DE) ..... 10 2008 010 548

(51) Int. Cl.
*H01F 27/30* (2006.01)
*H01F 27/06* (2006.01)
*H01F 27/00* (2006.01)

(52) U.S. Cl. ..... 336/208; 336/65; 336/185; 336/100

(58) Field of Classification Search ..... 336/65–68, 336/208, 196, 185, 100
See application file for complete search history.

(56) References Cited

U.S. PATENT DOCUMENTS 2,062,163 A * 11/1936 Conrad ..... 337/158
3,903,441 A * 9/1975 Towne ..... 310/71
5,534,839 A 7/1996 Mackin et al.
6,008,712 A 12/1999 Tokuda et al.
6,127,911 A 10/2000 Haller et al.
6,404,316 B1 6/2002 Busletta et al.
7,271,690 B2 * 9/2007 Bushnell ..... 336/83

FOREIGN PATENT DOCUMENTS

AT 3 10 866 B 10/1973
DE 6 03 240 A 9/1934
DE 35 663 C 1/1965
DE 53 189 C 1/1967
DE 1 01 053 C 10/1973
DE 23 49 121 A1 4/1975

(Continued)

OTHER PUBLICATIONS

International Search Report (PCT/ISA/210) for PCT/EP2009/001095 dated Jun. 30, 2009.

(Continued)

*Primary Examiner* — Mohamad Musleh
*Assistant Examiner* — Mangtin Lian
(74) *Attorney, Agent, or Firm* — Buchanan Ingersoll & Rooney PC

(57) ABSTRACT

The disclosure relates to a transformer having a yoke which has a crosspiece and at least two limbs, over which limbs a coil is placed in each case, and having at least one carrier on which the crosspiece is fixed and which has bearing faces for the coils. At least two supporting blocks for each coil are mounted on each bearing surface. The supporting blocks are fitted with elastic compensation elements on the coil-side carrying face and have, on their longitudinal side faces, which run perpendicular to a carrying surface, at least one strip which extends the creepage path and runs in the longitudinal direction and parallel to the carrying surface of the supporting block.

20 Claims, 3 Drawing Sheets

FOREIGN PATENT DOCUMENTS

| | | | | |
|---|---|---|---|---|
| DE | 26 23 156 | A1 | | 12/1977 |
| DE | 29 34 719 | A1 | | 3/1980 |
| DE | 2934719 | A | * | 3/1980 |
| DE | 41 40 460 | A1 | | 6/1993 |
| DE | 4140460 | A1 | * | 6/1993 |
| DE | 199 15 866 | A1 | | 10/1999 |
| DE | 201 05 608 | U1 | | 11/2001 |
| DE | 202 10 882 | U1 | | 10/2002 |
| EP | 0 936 637 | A2 | | 8/1999 |
| JP | 55034403 | A | * | 3/1980 |

OTHER PUBLICATIONS

Germany Search Report for DE 10 2008 010 548.1 dated Jan. 14, 2009.

* cited by examiner

TWO- OR MULTIPHASE TRANSFORMER

RELATED APPLICATIONS

This application claims priority as a continuation application under 35 U.S.C. §120 to PCT/EP2009/001095, which was filed as an International Application on Feb. 17, 2009 designating the U.S., and which claims priority to German Application 10 2008 010 548.1 filed in Germany on Feb. 22, 2008. The entire contents of these applications are hereby incorporated by reference in their entireties.

FIELD

The disclosure relates to a transformer for example, a two- or multiphase transformer and to supporting blocks for a transformer.

BACKGROUND INFORMATION

The disclosure relates, for example, to dry transformers or cast-resin/resiblock transformers with appropriate coil supports. These coil supports can be composed of plastic, and can be arranged below and/or above the coil. A function is to support the weight of the coil. Measures can be taken to lengthen the creepage distance. This can be achieved by plates which are adhesively bonded in between individual parts of the coil supports. For example, when a long creepage distance is desired, it may be desirable to adhesively bond a single coil support or a coil supporting block composed of a large number of individual parts, in order to achieve the lengthening of the creepage distance.

The production of such transformers can be costly.

SUMMARY

A transformer is disclosed comprising: a yoke which has a web and at least two limbs; a coil placed over each of the limbs; at least one mount, to which the web is fixed and which has plural bearing surfaces for plural transformer coils; at least two supporting blocks for each coil placed on each bearing surface; elastic compensation elements fitted to a coil-side mounting surface of the supporting blocks; and at least one strip on longitudinal side surfaces of the supporting blocks which run at right angles to the mounting surface, to lengthen a creepage distance, wherein the at least one strip runs in the longitudinal direction and parallel to the mounting surface of the supporting blocks.

A supporting block is disclosed for supporting a transformer having coils, the supporting block comprising: a coil side mounting surface for receiving a multiphase transformer coil; an elastic compensation element fitted to the coil-side mounting surface for receiving a multiphase transformer coil; and at least one strip formed on longitudinal side surfaces which run at right angles to the mounting surface and configured to lengthen a creeping distance of the supporting block, wherein the at least one strip runs in a longitudinal direction and parallel to the mounting surface.

BRIEF DESCRIPTION OF THE DRAWINGS

The disclosure as well as further advantageous refinements and improvements, and further advantages, will be explained and described in more detail with reference to the drawings, which illustrate a number of exemplary embodiments of the disclosure, and in which.

DETAILED DESCRIPTION

The disclosure relates to a transformer in which the coil can be supported by as few supporting blocks as possible, with the production of a sufficiently long creepage distance being simplified.

According to an exemplary embodiment of the disclosure, at least two supporting blocks for each coil can be placed on each bearing surface, which have elastic compensation elements fitted to the coil-side mounting surface, and which, on their longitudinal side surfaces, which run at right angles to the mounting surface, have at least one strip which lengthens the creepage distance. The strips run in the longitudinal direction and parallel to the mounting surface of the supporting block.

An exemplary embodiment of a supporting block is disclosed which, for example, can be produced using a so-called pultrusion process and in which, as a result of the selection of the shape, a lengthened creepage distance can be provided from the start on the longitudinal side surfaces of the supporting blocks.

According to an exemplary embodiment of the disclosure, at least one supporting block can have at least one slot on its end surfaces. The slots can be introduced in the direction of the mounting surface and parallel to it and can likewise be used to increase the creepage distance.

The at least one slot can, for example, be introduced outside the area of the strips.

According to an exemplary embodiment of the disclosure, at least one of the supporting blocks can be hollow. This reduces the amount of insulating material. The supporting block can therefore be lighter, and the internal cavity can also prevent stress cracks during curing.

The at least one hollow supporting block can have at least two, and in exemplary embodiments three, strips, depending on the desired length of the creepage distance.

In order to produce a supporting block, the strand produced using the pultrusion process can be shortened, with the supporting block being cut to the desired length easily from a long profile.

When a plurality of supporting blocks, for example two supporting blocks, are stacked one on top of the other, one supporting block can have a strip-like projection on the contact plane and the other can have a depression matched to it. The projection and depression run in the longitudinal direction, wherein the projection fits into the depression such that the two supporting blocks can be guided with respect to one another by the projection and the depression, in a similar manner to a tongue and groove.

The supporting blocks can have different heights. For example, it is possible to use a profile with a shorter height, thus allowing the height of the assembled supporting blocks to be matched to the specifications. Furthermore, a strip can also be integrated between the coil and the supporting block, in order to compensate for unevennesses of the coils. The strip may be composed of an elastic material, for example, a silicone rubber.

Figure 1:
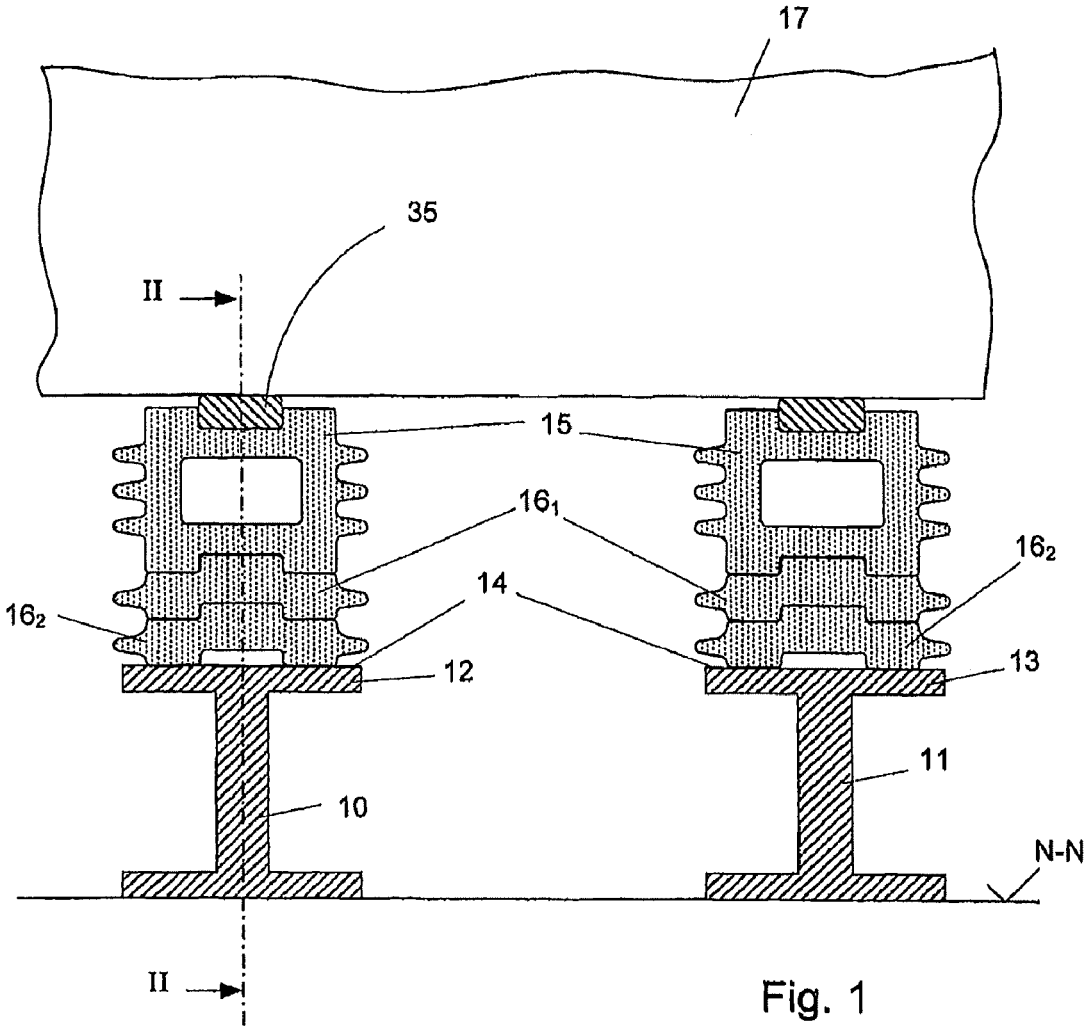
FIG. 1 shows a section view of an exemplary embodiment of supporting blocks along the section line I-I in FIG. 2.

Reference will now be made to FIG. 1.

Two double-T mounts 10 and 11 can be provided on a base NN and are mounted thereon. A coil 17 is placed on the opposite surfaces 14 of the upper lateral webs 12, 13 of the double-T mounts 10, 11 to the base, with the interposition of supporting blocks 15 and 16.

Figure 4:
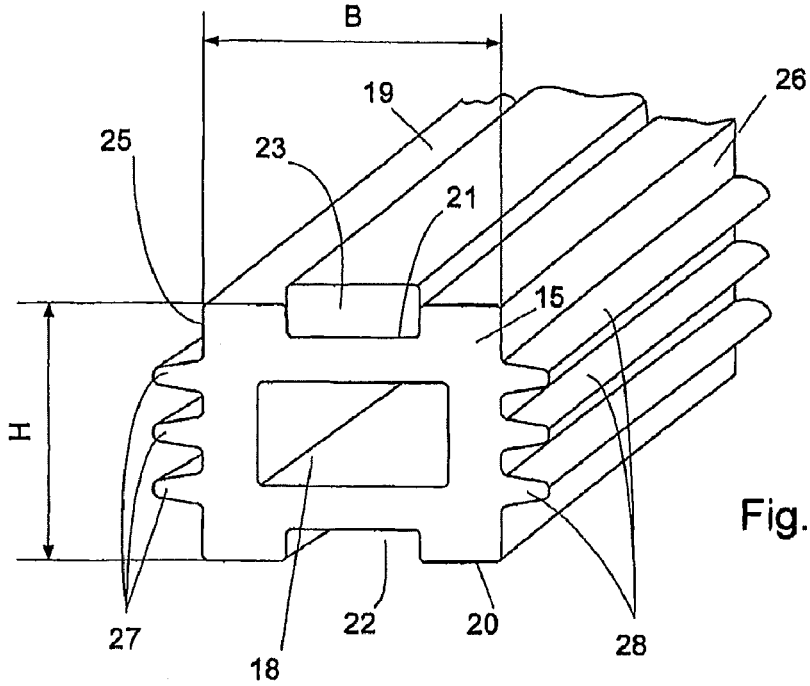
FIG. 4 shows an exemplary embodiment of a supporting block, illustrated in perspective form.

The supporting block 15 is illustrated in more detail in FIG. 4.

Figure 3:
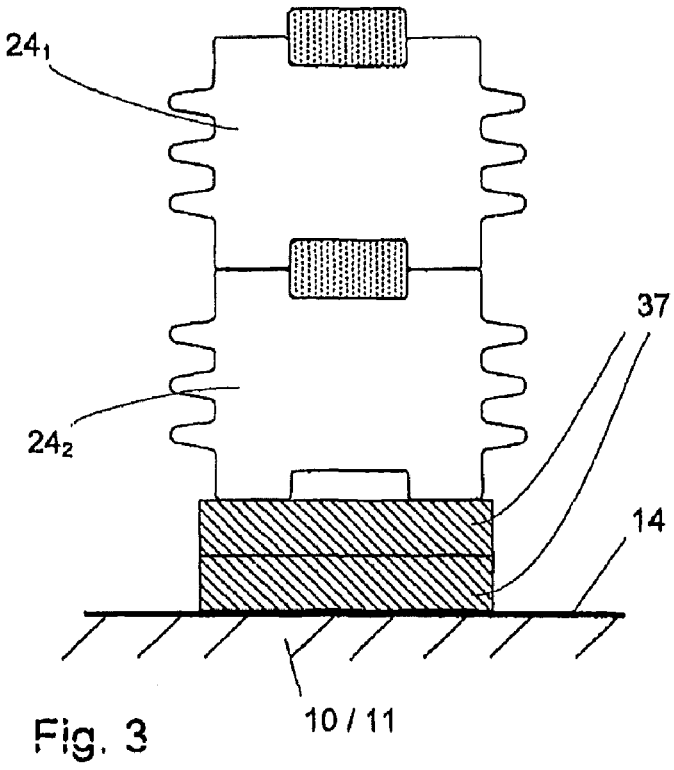
FIG. 3 shows a section view similar to that in FIG. 1, with an exemplary embodiment of two supporting blocks.

In a cross section at right angles to its longitudinal extent, the supporting block 15 has an approximately rectangular shape with a specific height H and a width B. The width B is less than the height H. The supporting block 15 has an internal cavity 18, thus reducing the weight and the amount of material used. An upper contact surface 19 and a lower contact surface 20, each having a width B, are provided on the supporting block 15. The length of the supporting block 15 depends on the size of the coil 17. There are grooves 21 and 22 in the contact surfaces 19 and 20, with a centering profile 23 being inserted into the groove 21 in the illustration shown in FIG. 4, and being used to provide twisting protection between two supporting blocks $\mathbf{24}_1$ and $\mathbf{24}_2$ which are arranged one on top of the other. See FIG. 3. The supporting blocks $\mathbf{24}_1$ and $\mathbf{24}_2$ in FIG. 3 differ from the supporting block 15 shown in FIG. 4 by not having a cavity 18.

Strips 27 and 28 can be provided on the side surfaces 25 and 26, which are at right angles to the contact or mounting surfaces 19 and 20. The strips 27 and 28 project outwards, run in the longitudinal direction of the supporting block 15 and project in the opposite direction outwards from the side surfaces 25 and 26, thus lengthening the creepage distance between the coil 17 and the double-T mounts 10, 11 on both side surfaces. The corresponding strips of the supporting blocks $\mathbf{24}_1$ and $\mathbf{24}_2$ are not provided with reference numbers there.

Figure 2:
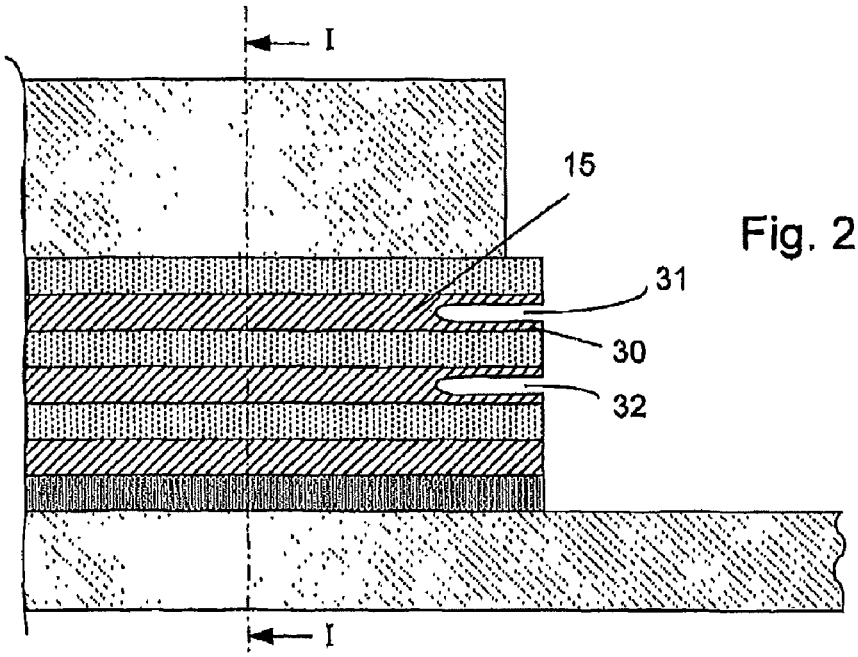
FIG. 2 shows a section view of an exemplary embodiment of supporting blocks corresponding to the section line II-II in FIG. 1.

As can be seen from FIG. 2, slots 31 and 32 can be provided on the end surfaces 30 of at least the supporting block 15, can be located outside the area of the strips and lengthen the creepage distance in the area of the end surface 30.

Figure 5:
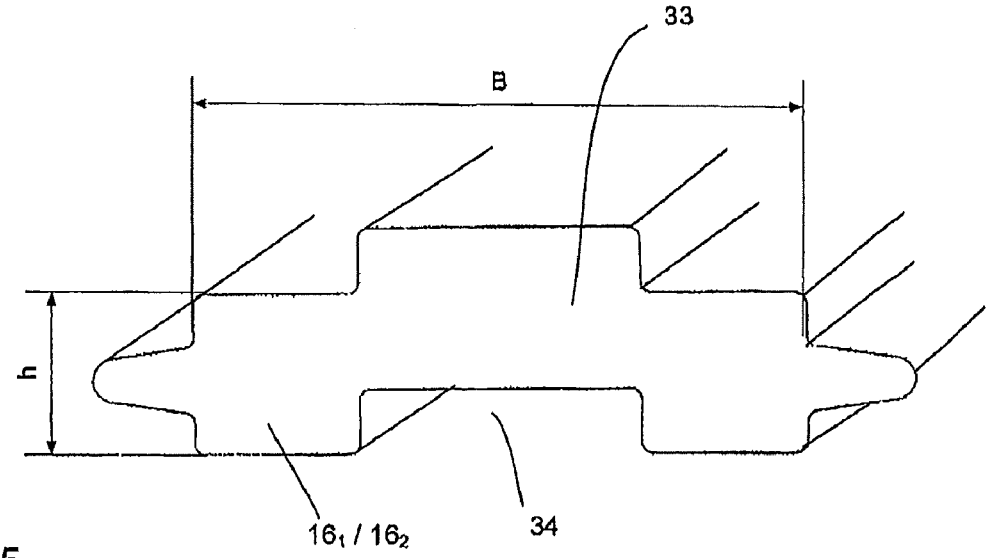
FIG. 5 shows a view of an exemplary embodiment of a supporting block for height matching, similar to FIG. 4.

In addition to the supporting block 15, FIG. 1 shows two supporting blocks $\mathbf{16}_1$ and $\mathbf{16}_2$, which are illustrated in FIG. 5. These have a width B which corresponds to the width of the supporting blocks 15 and a height h which is less, and in certain circumstances considerably less, than the height H of the supporting blocks. These supporting blocks $\mathbf{16}_1$ and $\mathbf{16}_2$ can be used to match the supporting blocks to the distance between the coil and the contact surface 14 of the mounts 10, 11. The supporting blocks $\mathbf{16}_1$, $\mathbf{16}_2$, which may be referred to as compensation pieces, have a projection 33 on the upper face (in the drawing) and, on the lower face, have a depression 34 which runs in the longitudinal direction, parallel to the projection 33, and corresponds to the depression 22. The projection 33 is of such a size that it can engage in the corresponding depression 22 in a further supporting block which is placed over the compensation piece 16, as is illustrated in FIG. 1.

A strip 35 composed of elastic material can be inserted into the groove or depression 21 (see FIG. 4) between the supporting block 15 and the coil 17, for example a strip composed of silicone rubber material, which can be used to compensate for any unevennesses on the lower face of the coil 17. The strips 35 may have the same dimensions as the centering profile 23.

Corresponding flat compensation materials can, of course, also be inserted between the individual supporting blocks 15 and compensation pieces $\mathbf{16}_1$, $\mathbf{16}_2$. In this case, the centering profiles 23 can be adhesively bonded into the depression 21. As can be seen from FIG. 3, two plates 37 can be inserted between the lower supporting block $\mathbf{24}_2$ and the contact surface 14 of the mount 10 or 11, and are used as compensation plates. More than two compensation plates or just one can, of course, also be provided.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

List Of Reference Symbols

10 Double-T mount
11 Double-T mount
12 Lateral web
13 Lateral web
14 Surface
15 Supporting block
16 Supporting block
$\mathbf{16}_1$ Supporting block
$\mathbf{16}_2$ Supporting block
17 Coil
18 Cavity
19 Upper contact surface
20 Lower contact surface
21 Groove
22 Groove
23 Centering profile
$\mathbf{24}_1$ Supporting block
$\mathbf{24}_2$ Supporting block
25 Side surface
26 Side surface
27 Strip
28 Strip
30 End surface
31 Slot
32 Slot
33 Projection
34 Depression
35 Strips

What is claimed is:

1. A transformer comprising:

a yoke which has a web and at least two limbs;

a coil placed over each of the limbs;

at least one mount, to which the web is fixed and which has plural bearing surfaces for plural transformer coils;

at least two supporting blocks for each coil placed on each bearing surface, wherein the two supporting blocks are stacked one on top of the other;

elastic compensation elements fitted to a coil-side mounting surface of the supporting blocks;

at least one strip on longitudinal side surfaces of the supporting blocks which run at right angles to the mounting surface, to lengthen a creepage distance, wherein the at least one strip runs in the longitudinal direction and parallel to the mounting surface of the supporting blocks; and a projection on one of the two supporting blocks on a contact plane between the two supporting blocks, another of the two supporting blocks having a first depression matched to the projection, wherein the projection and first depression run in the longitudinal direction, and wherein the projection fits into the first depression such that the two supporting blocks are guided with respect to one another by the projection and the first depression.

2. The transformer as claimed in claim 1, wherein at least one supporting block comprises:

at least one slot on end surfaces of the at least one supporting block, which slots are introduced in a direction of and parallel to the mounting surface for increasing the creepage distance.

3. The transformer as claimed in claim 2, wherein the at least one slot is formed outside an area of the at least one strip.

4. The transformer as claimed in claim 1, wherein at least one supporting block is hollow.

5. The transformer as claimed in claim 4, wherein the at least one hollow supporting block has at least two strips on each longitudinal side surface.

6. The transformer as claimed in claim 1, comprising:

at least one plate between at least one of the two supporting blocks and the mount.

7. The transformer as claimed in claim 1, comprising:

a second depression provided on one of the two supporting blocks; and an intermediate element inserted into the second depression.

8. The transformer as claimed in claim 7, comprising:

an intermediate layer composed of an elastomer material provided between the coil and the supporting block or the supporting blocks on which the coils are placed directly to compensate for unevennesses of the coils.

9. The transformer as claimed in claim 8, wherein the intermediate layer and dimensions thereof correspond substantially to those of the intermediate element, such that the intermediate layer can be inserted into the second depression.

10. The transformer as claimed in claim 4, wherein the at least one hollow supporting block has at least two strips on each longitudinal side surface.

11. The transformer as claimed in claim 8, wherein the intermediate layer is composed of silicone rubber.

12. The transformer according to claim 1, wherein the transformer is a two-or multiphase transformer.

13. A supporting block for supporting a transformer having coils, the supporting block comprising:

a coil side mounting surface for receiving a multiphase transformer coil;

an elastic compensation element fitted to the coil-side mounting surface for receiving a multiphase transformer coil;

at least one strip formed on longitudinal side surfaces which run at right angles to the mounting surface and configured to lengthen a creeping distance of the supporting block, wherein the at least one strip runs in a longitudinal direction and parallel to the mounting surface; and a projection on a contact plane for matching a depression formed on a second supporting block, wherein the projection and depression run in the longitudinal direction, and wherein the projection fits into the first depression such that the two supporting blocks are guided with respect to one another by the projection and the depression.

14. The supporting block as claimed in claim 13, comprising:

at least one slot on end surfaces of the supporting block, which slots are introduced in a direction of and parallel to the mounting surface for increasing the creepage distance.

15. The supporting block as claimed in claim 14, wherein the at least one slot is formed outside an area of the strips.

16. The supporting block as claimed in claim 13, wherein the supporting block is hollow.

17. The supporting block as claimed in claim 16, wherein the hollow supporting block has at least two strips on each longitudinal side surface.

18. The supporting block as claimed in claim 13, comprising:

a second depression is provided on one of the supporting blocks and an intermediate element is inserted into the second depression.

19. The supporting block as claimed in claim 18, comprising:

an intermediate layer composed of an elastomer material provided between the coil and the supporting block on which the coils are placed directly to compensate for unevennesses of the coils.

20. The supporting block as claimed in claim 19, wherein the intermediate layer and dimensions thereof correspond substantially to those of the intermediate element, such that the intermediate layer can be inserted into the second depression.

* * * * *